US010428581B2

(12) United States Patent
Crawford

(10) Patent No.: US 10,428,581 B2
(45) Date of Patent: Oct. 1, 2019

(54) WELL-DRILLING APPARATUS AND METHOD OF USE

(71) Applicant: Russell C. Crawford, Round Rock, TX (US)

(72) Inventor: Russell C. Crawford, Round Rock, TX (US)

( * ) Notice: Subject to any disclaimer, the term of this patent is extended or adjusted under 35 U.S.C. 154(b) by 0 days.

(21) Appl. No.: 15/918,322

(22) Filed: Mar. 12, 2018

(65) Prior Publication Data

US 2018/0266180 A1 Sep. 20, 2018

Related U.S. Application Data

(63) Continuation-in-part of application No. 15/230,353, filed on Aug. 5, 2016, now Pat. No. 9,915,113.

(60) Provisional application No. 62/246,631, filed on Oct. 27, 2015.

(51) Int. Cl.

| | |
|---|---|
| ***E21B 21/01*** | (2006.01) |
| ***E21B 21/14*** | (2006.01) |
| ***E21B 21/16*** | (2006.01) |
| ***E21B 7/02*** | (2006.01) |
| ***E21B 3/00*** | (2006.01) |
| ***E21B 34/06*** | (2006.01) |
| ***E21B 21/10*** | (2006.01) |
| ***E21B 11/00*** | (2006.01) |
| *E21B 34/00* | (2006.01) |

(52) U.S. Cl.

CPC ..... *E21B 3/00* (2013.01); *E21B 7/02* (2013.01); *E21B 11/005* (2013.01); *E21B 21/01* (2013.01); *E21B 21/103* (2013.01); *E21B 21/16* (2013.01); *E21B 34/06* (2013.01); *E21B 2034/007* (2013.01)

(58) Field of Classification Search

CPC ..... E21B 10/60; E21B 10/602; E21B 10/38; E21B 17/01035; E21B 2021/005; E21B 2021/007; E21B 2021/008; E21B 21/01; E21B 21/015; E21B 21/103; E21B 43/10; E21B 21/12; E21B 21/14; E21B 21/16; E21B 7/02; E21B 21/15

See application file for complete search history.

(56) References Cited

U.S. PATENT DOCUMENTS

| | | | | |
|---|---|---|---|---|
| 2,849,213 A * | 8/1958 | Failing | E21B 21/12 | 175/213 |
| 4,448,267 A * | 5/1984 | Crawford, III | E21B 17/00 | 175/213 |
| 4,809,788 A * | 3/1989 | Nelson | E21B 7/02 | 173/28 |
| 6,315,059 B1 * | 11/2001 | Geldean | E21B 7/028 | 173/112 |

* cited by examiner

*Primary Examiner* — Cathleen R Hutchins
(74) *Attorney, Agent, or Firm* — Hulsey PC

(57) ABSTRACT

Embodiments provide a well-drilling apparatus and a method of use.

4 Claims, 11 Drawing Sheets

WELL-DRILLING APPARATUS AND METHOD OF USE

CROSS-REFERENCE TO RELATED APPLICATIONS

This application is a continuation-in-part of co-pending application Ser. No. 15/230,353, filed Aug. 5, 2016, which is hereby incorporated by reference in its entirety. This application also claims priority to U.S. Provisional Patent Application 62/519,152, filed Jun. 13, 2017, which is hereby incorporated by reference in its entirety.

FIELD OF THE INVENTION

The present disclosure relates to a well-drilling apparatus and its method of use. Embodiments relate to a well-drilling apparatus which may be operable by hand or by mechanical means, and to an improved apparatus which may be operable by mechanical means.

BACKGROUND OF THE INVENTION

Currently, existing technology does not provide sufficient solutions for the drilling of wells by hand. A key deficiency includes the weight of existing tools that are necessary for drilling into the earth. Typically, the tools used for drilling are comprised of heavy metal and therefore require use of heavy and cumbersome handling equipment.

In addition, a further issue is that using existing technology, the reverse flow process requires that the rate of discharge of drilling fluid and the rate of introduction of air needs to be adjusted for varying conditions. For example, at shallow depths, the air lift reverse flow process is not efficient with respect to the materials that are being drilled. This may frequently lead to problems with regard to the penetration rate of the drill and to the plugging of the discharge port from which cuttings may be expelled from the drill stem.

Further, conventional direct circulation drilling rigs blow cuttings into the aquifer being drilled, eventually leading to blockage of the drilled well.

Further, powered drilling rigs require both a discharge swivel and air swivel. The discharge swivel is typically located on top of a drill stem, and does not turn even though the drill stem does. The air swivel is typically located on top of a drill stem, and turns even though the discharge swivel does not. Small powered drilling rigs typically use inexpensive swivels, but when drilling in sand the blowing sand typically blows through the swivels and erodes the swivels' rubber seals.

As result, what is needed is a drilling apparatus and method based upon the air lift reverse flow process, that is inexpensive, easy to transport, dependable, capable of drilling to hundreds of feet in depth, capable of operation by one or two persons without requiring heavy lifting equipment, uses simple materials, and may be adapted to be operable either by hand or with powered assistance. Elimination of swivels would also be desirable.

BRIEF SUMMARY OF THE INVENTION

The disclosed subject matter provides a well-drilling apparatus. The apparatus may comprise a hand adaptable portion that may allow individuals to drill wells by hand. or by attaching the apparatus to a suitable power unit. The apparatus may eliminate the need for heavy drilling tools and may furnish a drilling system that uses positive buoyancy to assist in drilling wells. The buoyancy of the apparatus may be achieved by using a light weight plastic drill stem that may be filled with air such that it floats within the borehole. In use, the drill stem may first be used to act as a conduit to transfer materials drilled by the drill bit to the surface using the reverse flow method. The upper end of the device may then be closed such that no fluid may exit the drill stem. Air may then be introduced into the drill stem and may accumulate within the closed drill stem. This air may be lighter than the water outside the drill stem and may induce the drill stem filled with air to float within the borehole filled with water. This may be accomplished by taking advantage of light weight plastics and other materials that have the ability to float in a borehole. Some of the materials used to construct the device may have a specific gravity less than the drilling fluid used in the drilling of the borehole.

In embodiments, the drilling apparatus may be comprised of a light weight drill stem that may be coupled together in sections that can be flooded with air and drilling fluid or only air or only drilling fluid.

The disclosed apparatus may adjust for drilling conditions that an individual may encounter by utilizing means to anticipate the strata through which an individual is drilling and locate drilling discharge ports such that the best penetration rates may be achieved.

The disclosed powered well-drilling apparatus, includes a mast; doors affixed to the mast, for deflecting well debris when secured in a closed position; stabilizers affixed to a bottom portion of the mast, for keeping the mast in the upright position; a power drive including a drill stem connection; and a drill stem comprising a tubular elongated body The tubular elongated body includes a plurality of tubular portions, a fastener removably affixing two of the plurality of tubular portions together, a plurality of discharge ports spaced along the length of the plurality of tubular portions and a plurality of removable plugs configured to engage and close off a corresponding one of the plurality of discharge ports. The powered well-drilling apparatus also includes plates with semicircular cutouts forming a hole, a ramp, a bit including a plurality of prongs and an inlet port, and an air hose retainer affixed adjacent to the bit. An open end of the air hose is disposed adjacent to the inlet port to create a reverse flow of air, water, and debris within the drill stem. As a portion of the drill stem with discharge ports in the open state is inserted into the well, lower discharge ports are closed when upper discharge ports reach a top edge of the well. The apparatus also includes an actuator for actuating the well-drilling apparatus in a rotatable motion to agitate debris found within the starter hole, and a mixture carrier for carrying a mixture of the agitated debris, the drilling water, and the air through the well-drilling apparatus to a surface of the well. The apparatus also includes an affixing mechanism for affixing the plurality of tubular portions to a top portion of the well-drilling apparatus adjacent a surface of the earth, each one of the plurality of tubular portions affixed to one another in succession as the power drive is actuated to force each tubular portion farther into the well.

BRIEF DESCRIPTION OF THE DRAWINGS

The novel features believed characteristic of the disclosed subject matter will be set forth in any claims that are filed now and/or later. The disclosed subject matter itself, however, as well as a preferred mode of use, further objectives, and advantages thereof, will best be understood by reference to the following detailed description of an illustrative embodiment when read in conjunction with the accompanying drawings, wherein:

DETAILED DESCRIPTION OF ILLUSTRATIVE EMBODIMENTS

Reference now should be made to the drawings, in which the same reference numbers are used throughout the different figures to designate the same components.

It will be understood that, although the terms first, second, third, etc. may be used herein to describe various elements, these elements should not be limited by these terms.

These terms are only used to distinguish one element from another element. Thus, a first element discussed below could be termed a second element without departing from the teachings of the present disclosure.

The terminology used herein is for the purpose of describing particular embodiments only, and is not intended to be limiting. As used herein, the singular forms "a", "an", and "the" are intended to include the plural forms as well, unless the context clearly indicates otherwise. It will be further understood that the terms "comprises" and/or "comprising" or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Figure 1:
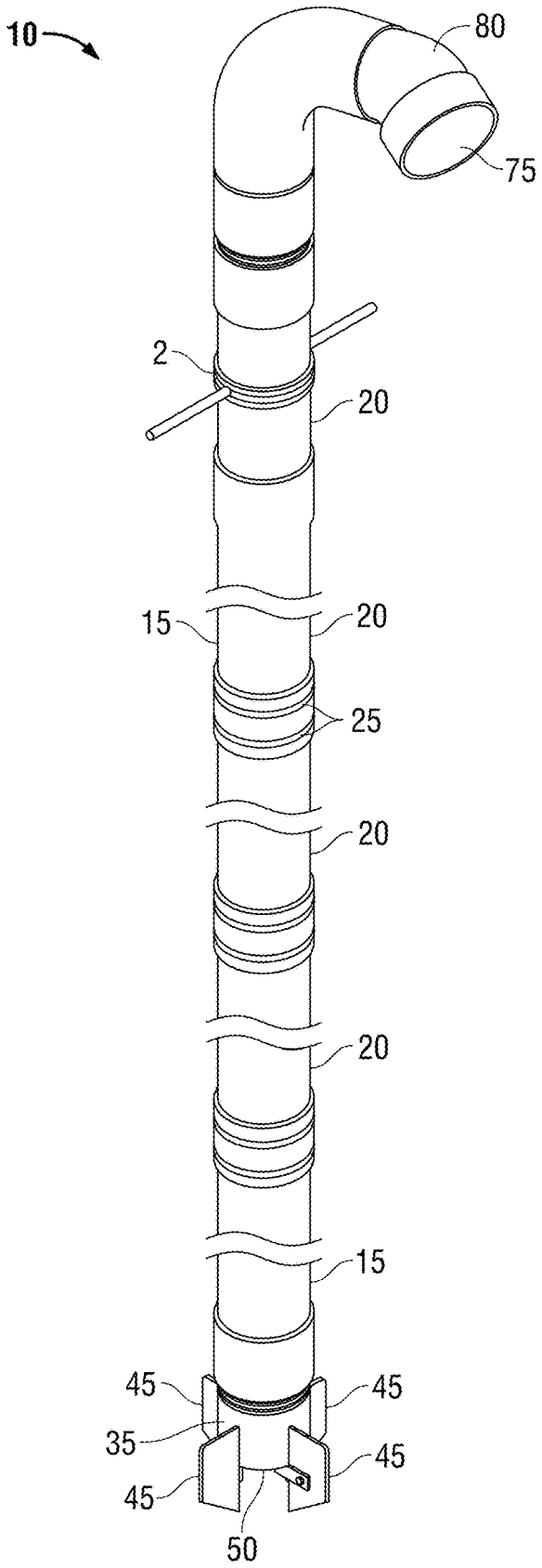
FIG. 1 displays a perspective view of a well-drilling apparatus in accordance with embodiments.

FIG. 1 displays a perspective view of a well-drilling apparatus 10 in accordance with embodiments. The well-drilling apparatus 10 may comprise a drill stem 15. As shown, the drill stem may be configured as an elongated body made up of a series, at least two or more, discrete tubular portions 20.

In some embodiments, each of the tubular portions 20 may be affixed to the adjacent tubular portion by means of a fastener. Thereby portion one is affixed to portion 2 by a first fastener, and portion two is affixed to portion three by means of a second fastener. Thereby, the resultant drill steam may include a plurality of fasteners 25. Each of the plurality of fasteners 25 may be affixed to at least two of the plurality of tubular portions 20 in order to keep the drill stem 15 from leaking. In some embodiments, a separate fastener may not be provided, instead, each of the plurality of tubular portions 20 may be connected with a connector, wherein the adjacent tubular portion 20 may have a reciprocal connector (for example, a male portion and a female portion).

Some instances of the apparatus 10 may be constructed of light-weight material. Some embodiments may also be configured such that internal cavities may be flooded with air and drilling fluid to provide buoyancy. In other embodiments, only air, or only drilling fluid, may be utilized as a carrier of debris from the bottom of the well 55.

Some embodiments may comprise an air hose 65. An exemplary air hose 65, as shown, may be affixed to a supply of compressed air and a bit 35 dischargeable into a drill stem 15 that may allow the apparatus 10 to perform as an air lift reverse flow drill.

As shown, an apparatus may include a plurality of discharge ports 30 spaced along the length of the plurality of tubular portions 20. The ports 30 may release debris when the ports 30 are open.

An apparatus may further include a bit 35, which may be affixed to, a bottom, or first in the series if measured from the base, of tubular portions 40. The bit 35 may comprise a plurality of prongs 45 and an inlet port 50 that may be utilized to agitate and receive debris found within a well 55. In embodiments, the bit 35 may be of some other design such as, but not limited to, a roller bit or other commonly used drilling bit.

Some embodiments may further provide an air hose retainer 60, which may be affixed adjacent to the bit 35. An exemplary air hose retainer 60 may be configured to retain a portion of an air hose 65 when the apparatus 10 is utilized within a well 55. An open end 70 of the air hose 65 may be disposed adjacent the inlet port 50 (also adjacent the air hose retainer 60) to create a reverse flow of air, water, and debris within the drill stem 15 in response to the high pressure created by pumping air into the bottom of the well 55.

In some embodiments, an outlet port 75 may be provided and affixed to, a top, or end in the series if measured from the base, of tubular portions 80. The top tubular portion 80 may refer to a tubular portion 20 of the plurality of tubular portions 20 that is positioned at the mouth of the well 55. As the bit 35 digs deeper into the well 55, more and more of the tubular portions 20 may be forced into the well 55. Therefore, different tubular portions 20 may be positioned at the mouth of the well 55. In embodiments, the top tubular portion 80 may be curved, such as those found in FIGS. 1 and 2. In other embodiments, the top tubular portion 80 may be straight, such as those found in FIGS. 3A and 3B. Each of the different tubular portions 20 that are positioned at the mouth of the well 55 may contain the outlet port 75. The exemplary outlet port 75 shown is configured with a curved body. In embodiments, the outlet port 75 may be affixed to, at least one of the plurality of tubular portions 20 via at least one of the following: male-female engagement and strap retainers.

Some embodiments, may further comprise a cap 85 that may be affixed to a top tubular portion 80. When the apparatus 10 has not yet hit groundwater, the cap 85 may close off the end of the top tubular portion 80. When the apparatus 10 hits water, water may be produced from the well 55 and may exit the apparatus 10 through the outlet port 75 when not closed off by the cap 85.

Some embodiments, may further comprise an air hose 65 that may be positioned within the drill stem 15. In one arrangement, the air hose 65 may be fed through an orifice 90 in a portion of the apparatus 10 (on one of the plurality of tubular portions 20); the orifice 90 may be positioned on a wall of one of the plurality of tubular portions 20. A plurality of air hose retainers 60 may be positioned along an interior wall of the drill stem 15 in order to securely retain the air hose 65 the entire length of the drill stem 15 and down to the inlet port 50.

In embodiments, the apparatus 10 may respond to a computer program stored on a computing system 115 that may open and close actuators 105 that may move the discharge ports 30 and adjust the drilling air/fluid to move the apparatus 10 within the well 55 to assist in the drilling of the well 55 or remove the apparatus 10 from the well 55.

In embodiments, a plurality of removable plugs 95 may be configured to engage and close off the plurality of discharge ports 30. In embodiments, a plurality of actuators 100 may be connected to a computing system 115. The computing system 115 may send protocol to the plurality of actuators 100 to move the plurality of removable plugs 95 adjacent the plurality of discharge ports 30.

In embodiments, the apparatus 10 may be assembled in the field in order to adjust for the types of strata drilled and for the type of drilling fluid and amount of air available to use in the drilling process.

In embodiments, the apparatus 10 may comprise a handle portion 185 that may affix around any of the plurality of tubular portions 20. The handle portion 185 may be useful when manually rotating the apparatus 10 within a well 55. In embodiments, the handle portion 185 may tighten to the apparatus via a screw that, when turned, may pull together portions of the handle portion 185.

A spacing scheme may be calculated for the apparatus 10. The location of the plurality of discharge ports 30 on the apparatus 10 may be varied based upon the percent of submersion of the ports 30 compared to the location of the outlet port 75 in the drill stem 15. For example, it may be desired to have a submersion of 80 percent when drilling extremely dense materials and a submersion of 65 percent when drilling loosely compacted sand. By doing so, the penetration rate of the apparatus 10 may be increased. The adjustment of drilling parameters may also allow for the increasing of the velocity of the drilling fluid within the drill stem 15, thereby allowing for an increase in the carrying capacity of the drill fluid to remove cuttings from the well 55. Faster velocity may lead to increased ability to remove cuttings from the well 55. In embodiments, varying the amount of air used to assist in the drilling process and removal may increase the efficiency of the apparatus 10. This may be carried out by closing off the plurality of discharge ports 30 and the top cap 85 of the apparatus 10. This may additionally be carried out by adjusting the flow of the plurality of discharge ports 85 and the volume of air presented at the bit 35 or above the bit 35.

Figure 2:
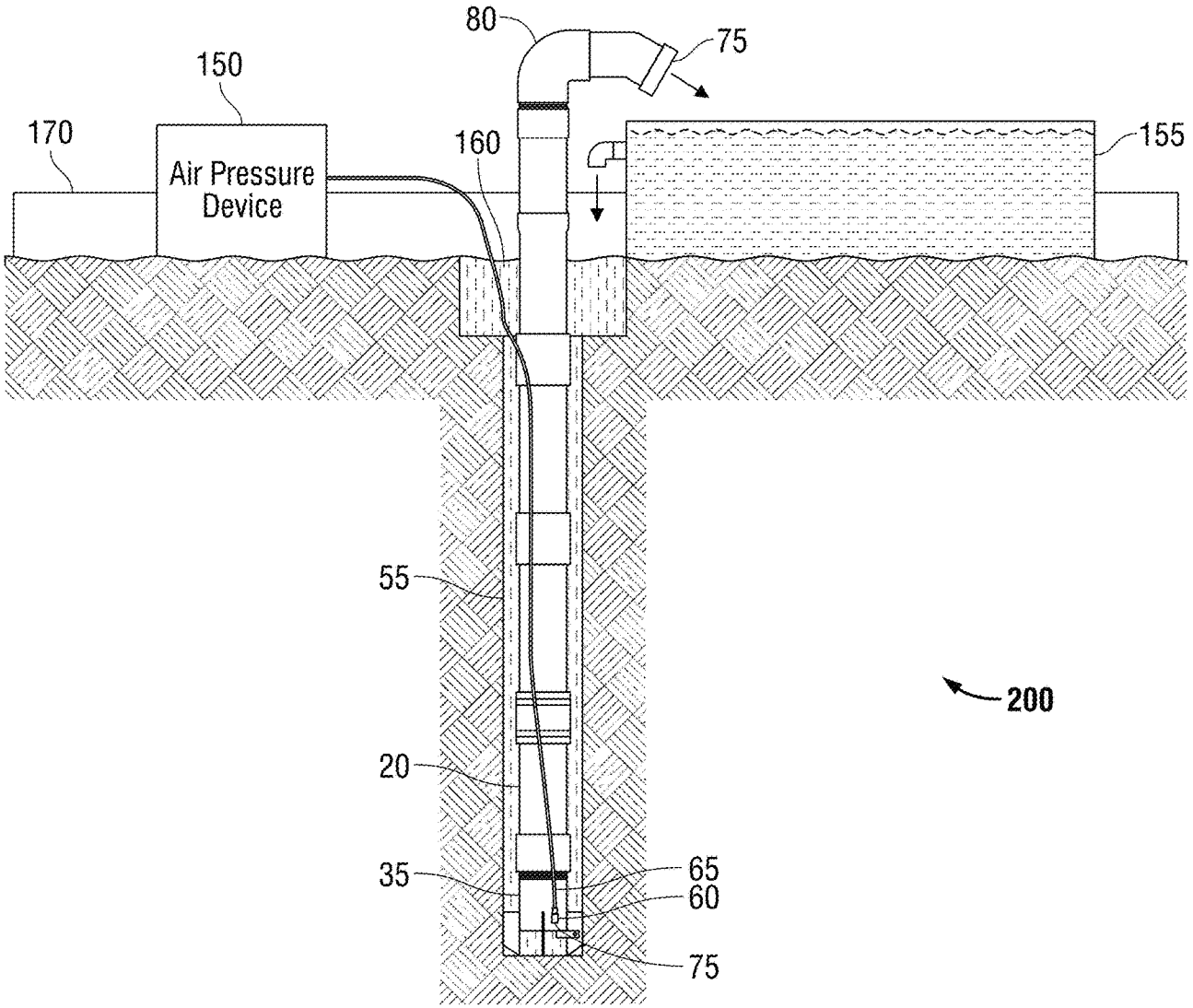
FIG. 2 displays a perspective view of a well-drilling system in accordance with embodiments.

FIG. 2 displays a perspective view of a well-drilling system 200 in accordance with embodiments. An air pressure device 150, such as for example, an air compressor 190, may be turned on so that air may be supplied to the bottom of the well 55 while the apparatus 10 is turned back and forth at a 45-degree angle and may be allowed to sink into the earth. In embodiments, the apparatus 10 may be moved at an angle greater than 45 degrees. In embodiments, the apparatus 10 may be moved a full 360 degrees either a single time or multiple times. The air supplied may provide a reverse suction at the bottom end of the apparatus 10. This suction may pull up loose dirt and gravel, as well as water, up through the drill stem 15 and up to the surface. In embodiments, the air compressor 190 may embody the following specifications: 12 CFM at 90 PSI.

Drill water must be readily available in order to drill the well 55, which may be supplied via a water tank 155. A starter hole 160 (in embodiments, 3 feet deep) may then be dug at the well site that may be the same diameter or larger in diameter than the bit 35 of the apparatus 10. In embodiments, a set of post-hole diggers may be utilized in order to create the starter hole 160. Around the starter hole 160, an enclosure 170 created via barriers may be created that may keep the drill water in a confined area. In embodiments, the enclosure 170 may be constructed using a plurality of wooden planks.

Figure 3A:
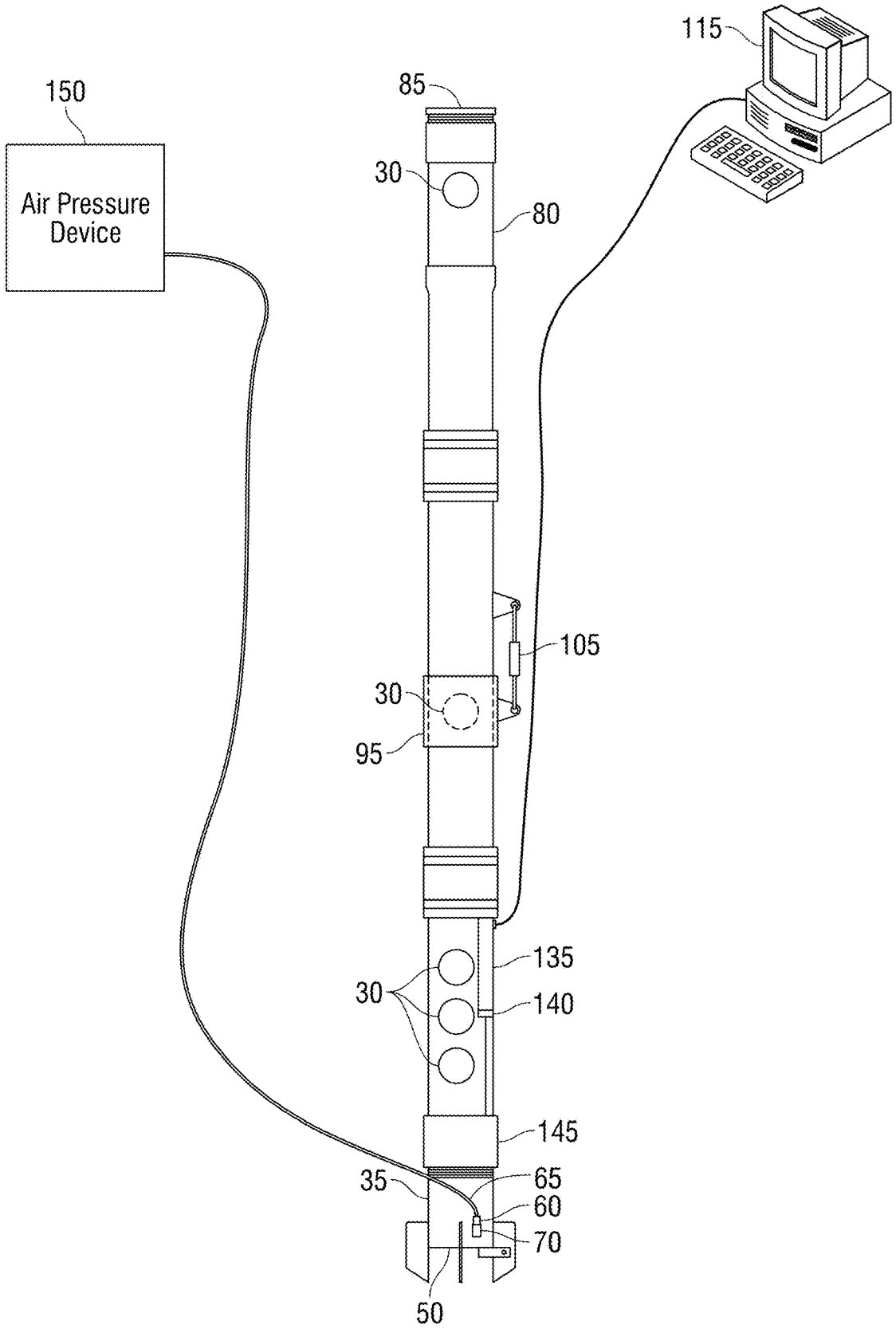
FIG. 3A displays a perspective view of an alternative well-drilling apparatus in accordance with embodiments.

FIG. 3A displays a perspective view of an alternative well-drilling apparatus in accordance with embodiments. The apparatus 10 may be adaptable to receive down-hole drilling attachments. In embodiments, the apparatus 10 may include a receiver/accumulator 135 that may add buoyancy to the apparatus 10 such that the weight of the apparatus 10 is offset by the buoyancy of the receiver or accumulator 135. The receiver/accumulator 135 may contain a quick release dump valve 140 that may allow for a quick release of the contents of the accumulator 135 in order to assist the apparatus 10 with a burst of energy to enhance the drilling process. The accumulator 135 may be designed to handle liquids or air.

In embodiments, the apparatus 10 may be fabricated with light-weight metals or plastics such that only as much mass as is needed can be applied in relation to the materials to be drilled. In addition, the air or hydraulically driven apparatus 10, whether it is a hammer type or a rotating type tool or driven by drill fluid, may additionally include an appropriately matched rigid section 145 leading to the plastic or light weight section such that the energy of the bit 35 may first be dissipated in the rigid section 145, thereby extending the life of the light weight section.

Figure 3B:
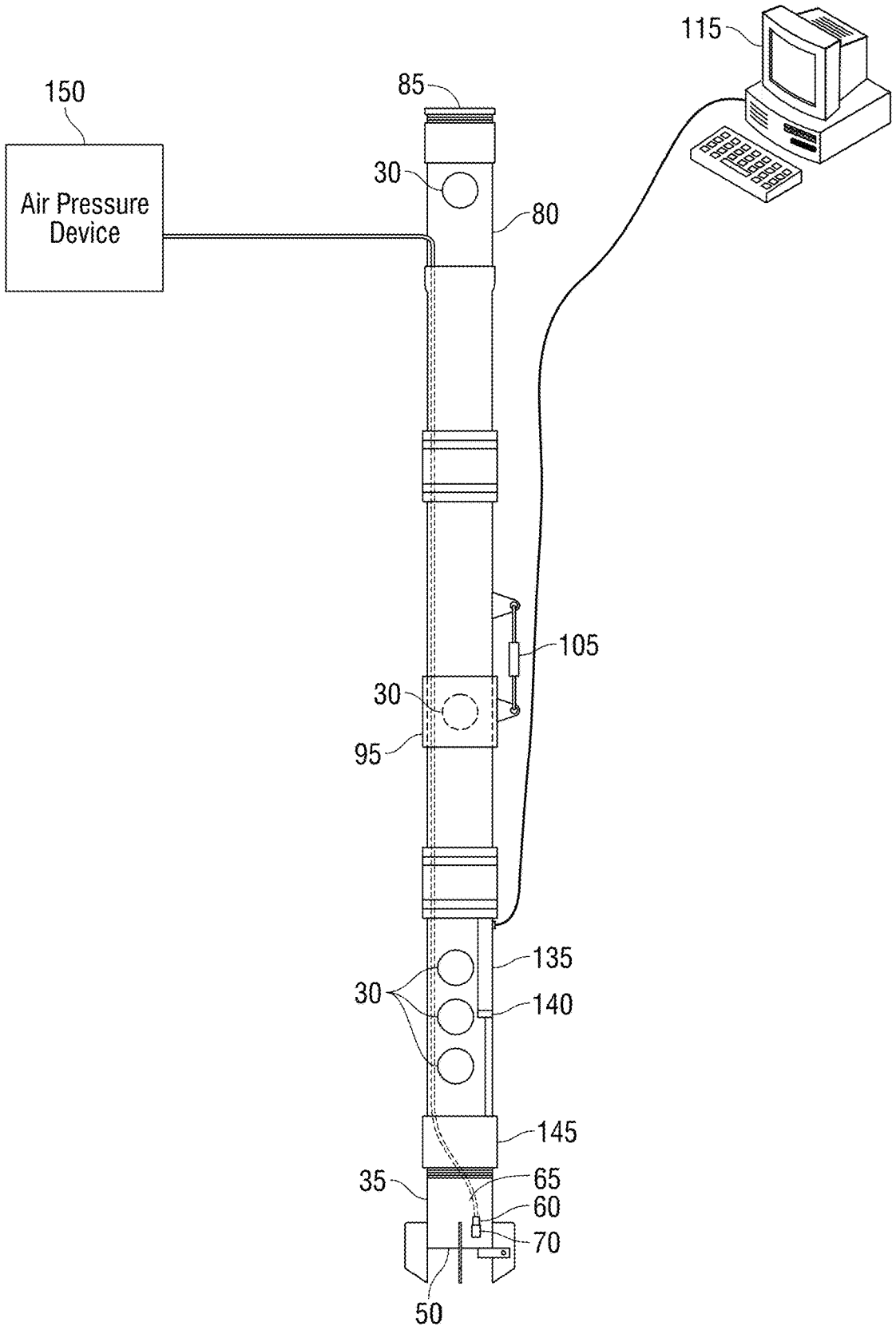
FIG. 3B displays a perspective view of an alternative well-drilling apparatus including an internal air hose in accordance with embodiments.

In embodiments, the air hose 65 and air hose retainer 60 may be located within the apparatus 10, which may be shown in FIG. 3B.

Figure 4:
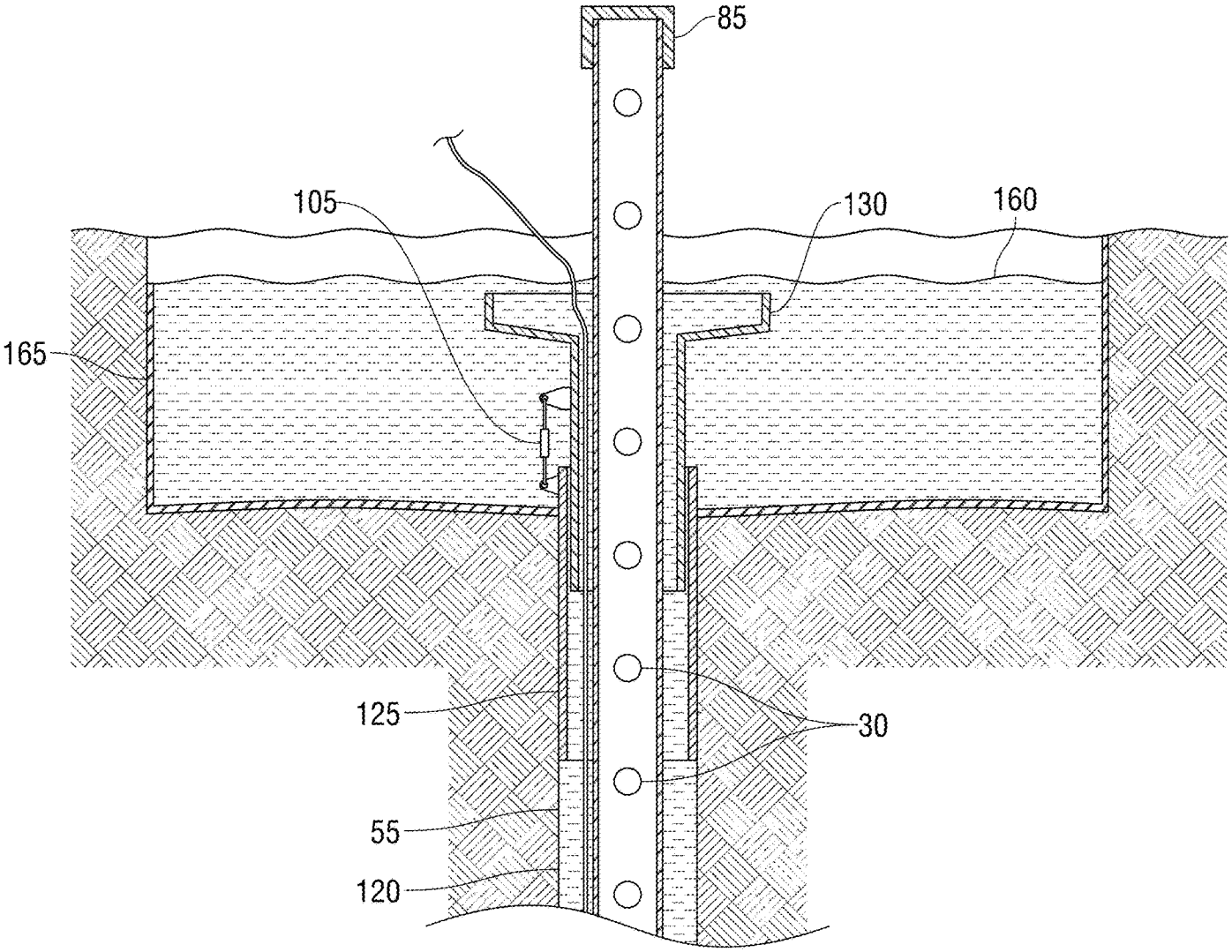
FIG. 4 displays a perspective view of a well-drilling apparatus partially engulfed in a well in accordance with embodiments.

FIG. 4 displays a perspective view of a well-drilling apparatus 10 partially engulfed in a well 55 in accordance with embodiments. The apparatus 10 may increase the hydraulic pressure on the interior walls 120 of the earth within the well 55. Site conditions where a well 55 is to be installed sometimes includes locations where the static water elevation prior to drilling or close to or above the soil through which the well 55 may be installed. In situations where the in-situ static water level is equal to or greater than the water level within the drill stem 15 before filling with fluid, caving of the well 55 may occur. In embodiments, caving may occur when other conditions exist. In such situations, if the soil through which the apparatus 10 must drill caves into the well 55, it may be helpful to apply hydraulic pressure to the walls 120 of the well 55 in order to prevent caving.

In embodiments, the apparatus 10 may include a surface casing 125 that may extend above the static water level such that a positive hydraulic head may be maintained on the walls of the well 55. To achieve a positive hydraulic head, the inlet of the well 55 may be elevated via an extended casing 125 that may be matched and sealed with a suitable tank or portable mud pit 130 that may be affixed to the surface casing 125. The mud pit and casing 130 may be adjustable to an increased elevation by moving the apparatus 10 to a progressively increased elevation via hydraulic means or other means such as, but not limited to, mechanical means. In embodiments, the casing 125 may cover at least a portion of the interior walls of the well 55 in order to reduce the risk of the well 55 collapsing on itself.

Figure 5A:
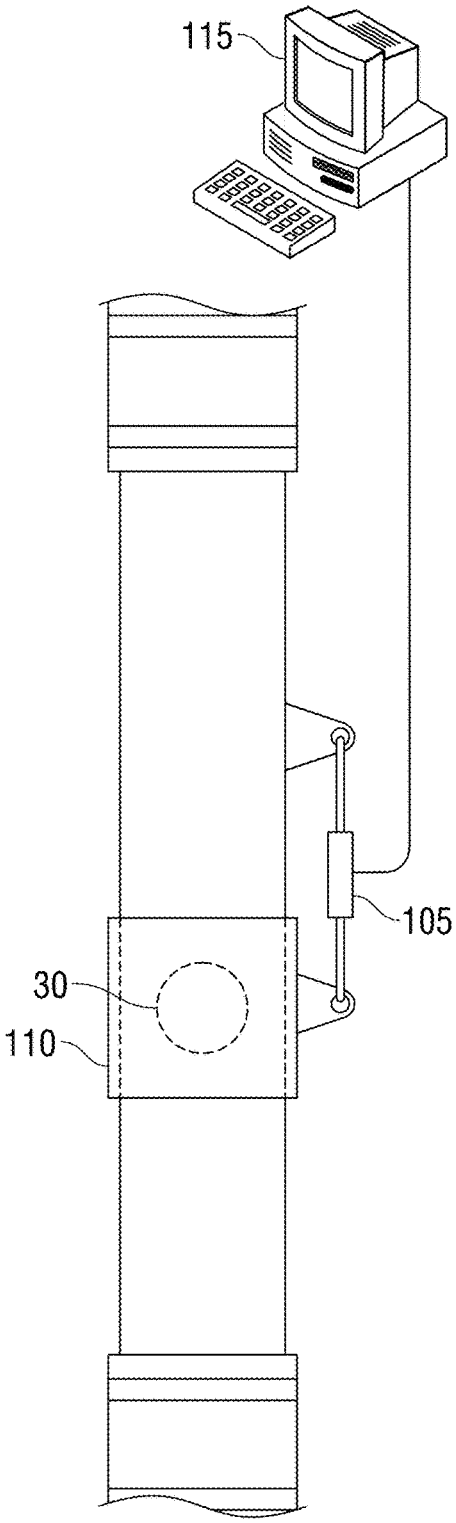
FIG. 5A displays a zoomed-in view of a portion of a well-drilling apparatus in accordance with embodiments.
Figure 5B:
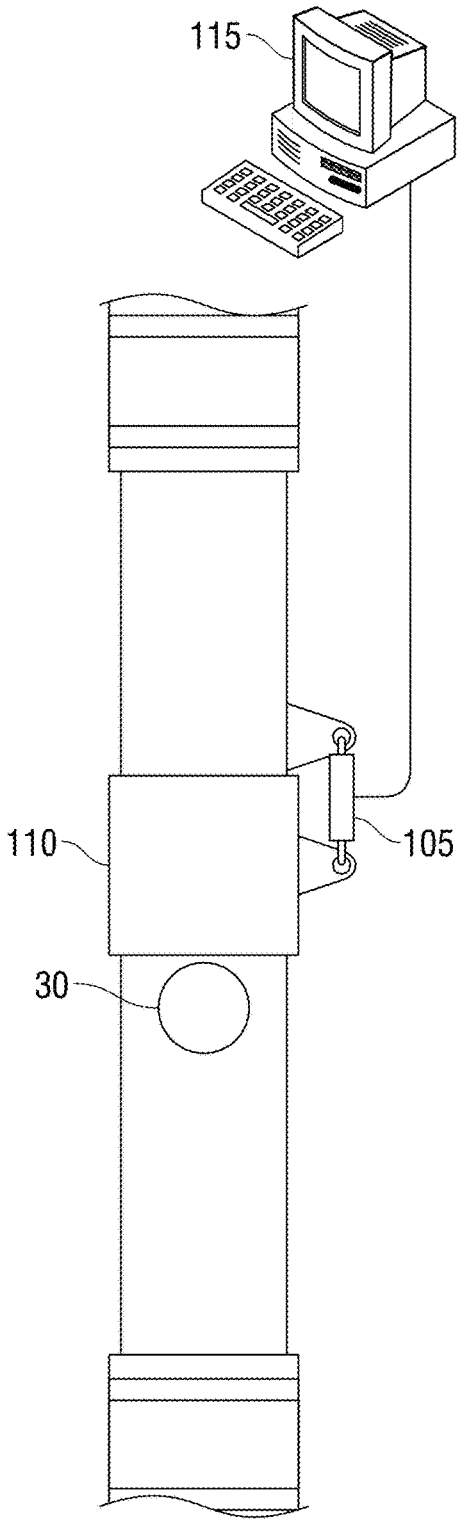
FIG. 5B displays a zoomed-in view of a portion of a well-drilling apparatus in accordance with embodiments.

FIGS. 5A and 5B display a zoomed-in view of a portion of a well-drilling apparatus 10 in accordance with embodiments. The plurality of discharge ports 30 may include assisted closing ports 110. This may allow for remote operation of the apparatus 10. Remote operation may further allow the apparatus 10 to automatically drill a well 55 during some portion the time it takes to complete the drilling process. For example, the apparatus 10 may be fitted with means that close the discharge ports 30 and valve/cap such that the drill stem 15 may fill with air and float in the drilling fluid in the well 55. The computing system 115 that closes the assisted closing ports 110 may be timed such that the drill stem 15 may be filled with air making the drill stem 15 buoyant within the borehole, causing the drill stem 15 to rise above the drilling fluid within the well 55. The computing system 115 may then open the assisted closing ports 110, causing the drill stem 15 to lose buoyancy and drop within the well 55, such that its weight may cause the bit 35 to drill into the earth at the bottom of the well 55. Closing the discharge ports 30 may cause the apparatus 10 to rise and opening the ports 30 may cause the apparatus 10 to drop, thereby imparting a chopping action to the bit 35. In embodiments, the discharge ports 30 may be closed via mechanical means such as, but not limited to: arms, levers, ropes, or similar means. The discharge ports 30 may additionally be closed via electromechanical valves and/or cylinders, or other means.

Figure 6:
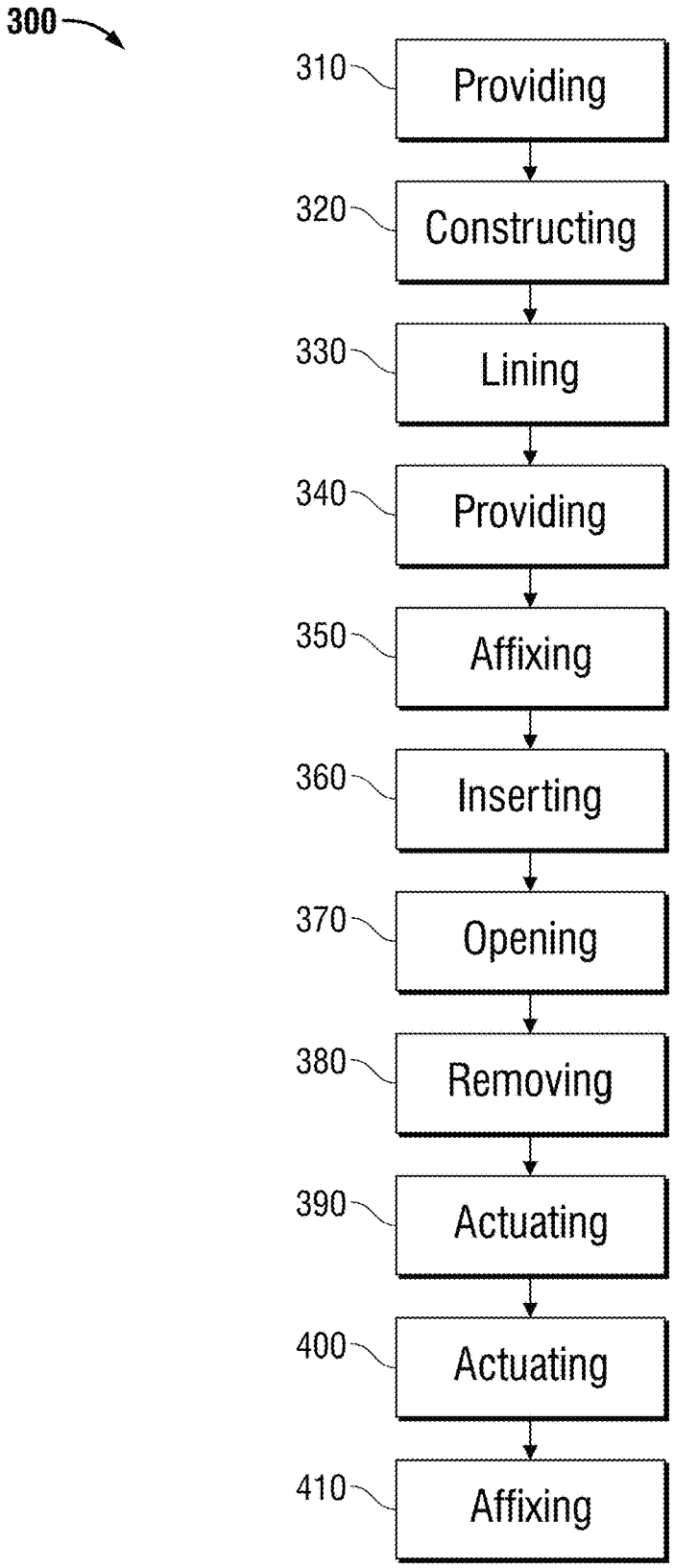
FIG. 6 displays a method for drilling a well in accordance with embodiments.

FIG. 6 displays a method 300 for drilling a well in accordance with embodiments. A well-drilling apparatus 10 may be provided 310. The well-drilling apparatus 10 may comprise one or more components as disclosed herein. A starter hole 160, having an interior surface area, may be constructed 320 within the earth. Once created, the starter hole 160 may be lined 330 with plastic 165 in order to keep the starter hole 160 from collapsing on itself. Once lined, the starter hole 160 may be provided 340 with drill water utilized to assist in the drill within the starter hole 160. Before inserting the apparatus 10, an air hose 65 may be affixed 350 to a brass inlet positioned at a bottom end of the apparatus 10 (see FIG. 2). The apparatus 10 may then be inserted 360 into the pre-dug starter hole 160 and the first port above the water elevation may be opened 370. At that point, the plastic 165 may be removed 380 from the starter hole 160 and the air pressure device may be actuated 380 in order to provide air to the air hose 65. At this point, the apparatus 10 may be actuated 390. The apparatus 10 may be actuated 390 in a rotatable motion, which may allow the apparatus 10 to agitate debris found within the starter hole 160. A mixture of the debris, the drilling water, and the air may be carried through the well-drilling apparatus 10 to the surface of the well 55.

Throughout the creation of the well, the apparatus may be kept plumb. Once the apparatus 10 sinks deep enough to where a second discharge port 30 reaches the top edge of the well 55, the second discharge port 30 may be opened and a first discharge port 30 may be closed. In embodiments, the air may be shut off and then turned on again when changing discharge ports 30. The process of opening and closing ports 30 may continue until the last port 30 on the apparatus 10 is opened and closed. Once the last port 30 is closed, a cap 85 may be removed from the top of the drill stem 15. An outlet port 75 may be placed in the position where the cap 85 had existed.

Once the drill stem is mostly submerged in the well, the outlet port 75 may be removed and an additional tubular portion 20 (without discharge ports 30) may be affixed 410 to the mostly submerged drill stem 15 via a fastener 25. The outlet port 75 may be reinserted onto the installed tubular portion 20 and the drilling may continue.

When that drill stem 15 is again mostly submerged, the outlet port 75 may again be removed and an additional tubular portion 20 may be affixed 410 in a similar fashion as the previous tubular portion 20 added. In embodiments, the tubular portion 20 may be 5 feet long. The process of drilling and affixing 410 tubular portions 20 may be repeated until the apparatus 10 reaches water at the bottom of the well 55.

It is noted that the apparatus 10 leaves open the bottom of the drill stem 15 (via inlet port 50) and may still have the capability of drilling a well 55. When the apparatus 10 is filled with air by plugging the outlet port 75, the drill stem 15 may rise in the well 55. As the air is released, the drill stem 15 may drop within the well 55 and may "chop" the soil under the bit 35. In embodiments, the drill stem 15 may be open on the bottom such that when the air is introduced within the drill stem 15 while the outlet port 75 is closed, the drill stem 15 may become buoyant and may float out of the well 55. The air within the drill stem 15 may not be restrained from driving out the fluid and the air in its trapped state, which causes the apparatus 10 to float mostly out of the well 55 or within the well 55 to a controlled extent. This may be very important because the chopping action of the bit 35 may be dependent upon the drill stem 15 floating up and dropping down to chop the soil once the air is released from the apparatus 10. It is additionally important during the removal of the drill stem 15 from the well 55.

It is further noted that the location of the discharge ports 30 may be determined based upon the best cutting and discharge rate achieved within the drill stem 15 of the apparatus 10. A formula may provide a direct relationship between percent submersion of the drill stem 15 with regard to the distance submerged between the top of the drilling fluid in the starter hole 160 and the inlet port 50 for air that leads into the bottom of the drill stem 15. This relationship may be important if an individual is attempting to make the most efficient apparatus 10 for a specific soil stratum. The formula is: the depth of the current submersion multiplied by the number one, divided by the percent of submersion of the apparatus 10 (in decimal form). As an example, if the current submersion is three feet and the percent of submersion is 75 percent, the formula may show: $3\ \text{ft} \times 1/0.75 = 4\ \text{ft}$. The second/subsequent submersion depths can be determined so that the submersion depth induces a discharge matched to remove the cuttings of the drill bit at the most efficient discharge speed.

The importance of the formula may lie in the fact that by increasing the submersion of the apparatus 10, one may increase the velocity of the drill fluid in the pipe and by decreasing the submersion of the apparatus 10, one may decrease the velocity of the drilling fluid in the pipe. The formula may be important when an individual considers that the specific gravity of the drill fluid increases with the specific gravity of the material in suspension and the speed with which one may penetrate the stratum being drilled. The formula may allow an individual to design a drill that may penetrate different strata at rates that are both efficient with regard to air/energy used and the penetration rate of the apparatus 10 into the various strata.

Figure 7:
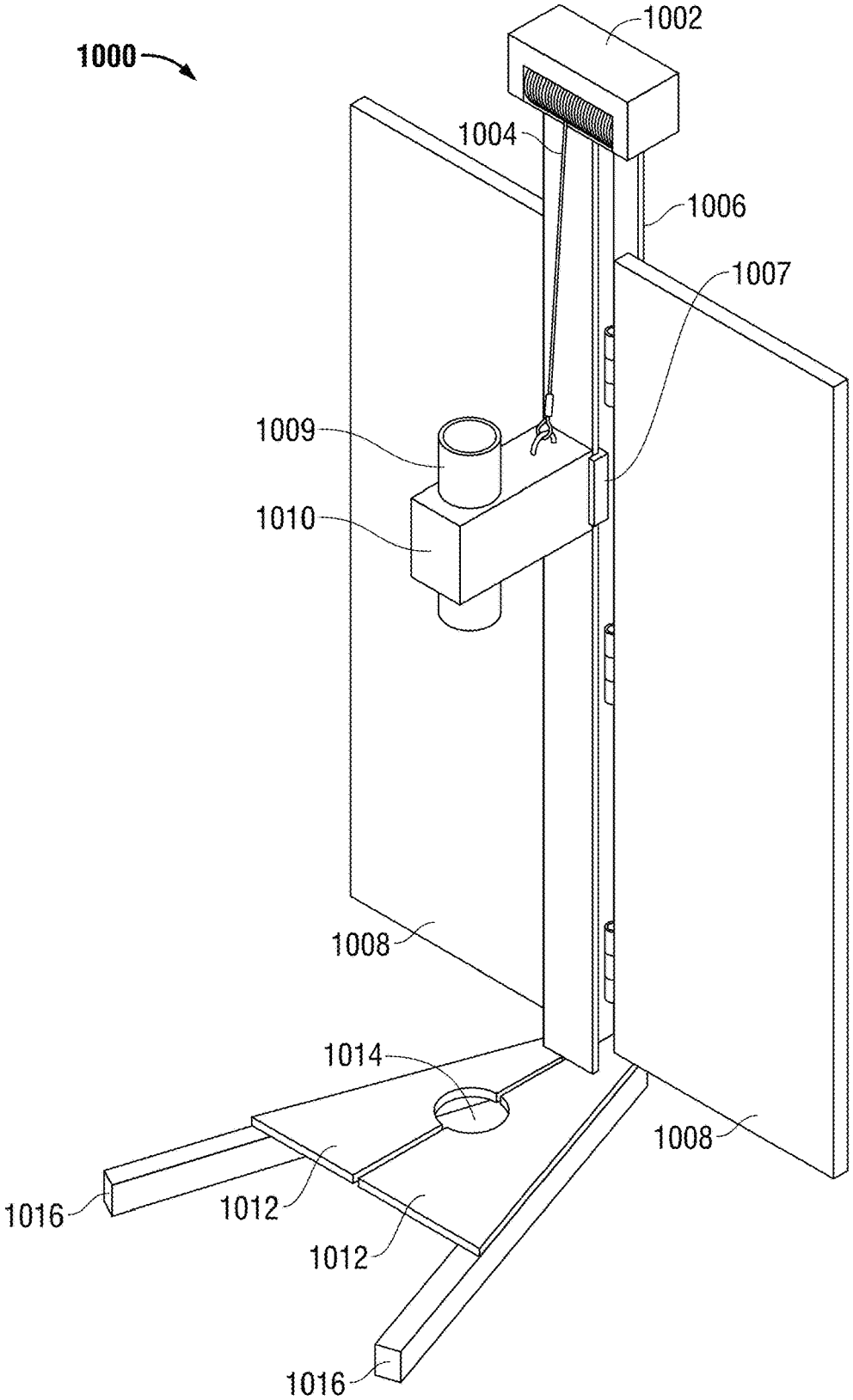
FIG. 7 displays a perspective view of an alternative well-drilling apparatus in the non-operational state, in accordance with embodiments.

FIG. 7 displays a perspective view of an alternative well-drilling apparatus 1000 in the non-operational state, in accordance with embodiments. While apparatus 10 includes tubular portions 20 that may be actuated in a rotatable motion using any feasible option, in apparatus 1000 tubular portions 20 are actuated in a rotatable motion using a power drive.

As illustrated in FIG. 7, mast 1006 supports winch 1002, slide 1007, power drive 1010 having drill stem connection 1009, doors 1008, and stabilizers 1016. Cable 1004 connects winch 1002 with power drive 1010. Mast 1006 may be a wide flange beam, with slide 1007 mounted on the outside of one flange. In use, power drive 1010 may slide down mast 1006 along slide 1007. When power drive 1010 reaches the bottom of mast 1006, winch 1002 may use cable 1004 to raise power drive 1010 back to the top of mast 1006 along slide 1007. Alternatively, a gear box and chain may be employed instead of winch 1002 and cable 1004. Alternatively, winch 1002 may be used to lower power drive 1010 as well as to raise power drive 1010.

Figure 8A:
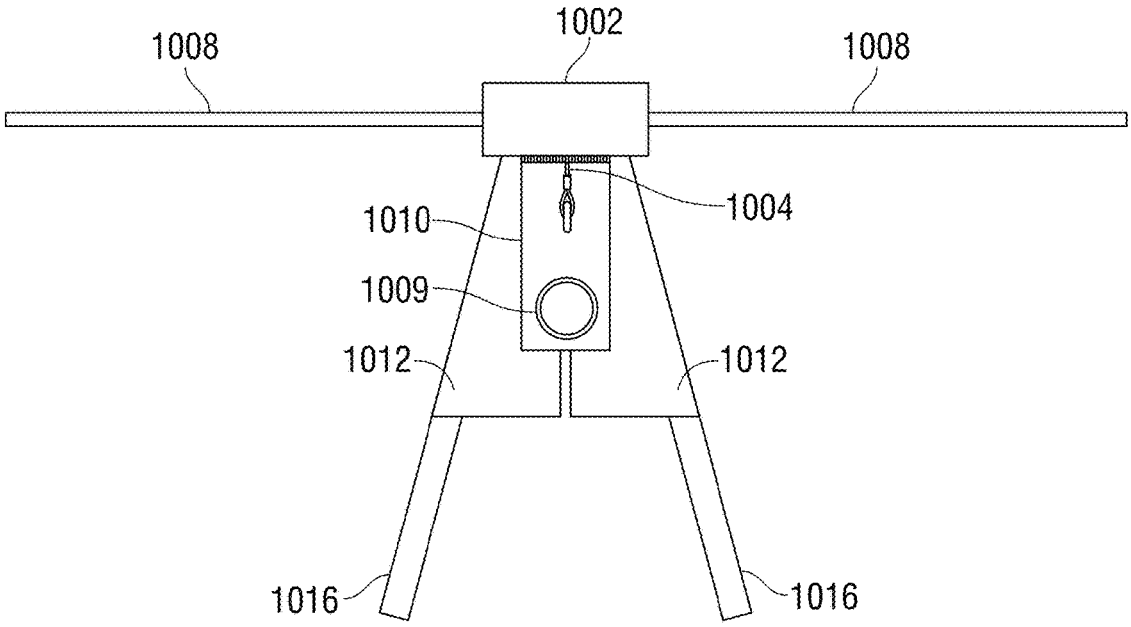
FIGS. 8A and 8B depict top views of an alternative well-drilling apparatus, with doors 1008 in the open and closed states, respectively, in accordance with embodiments.
Figure 8B:
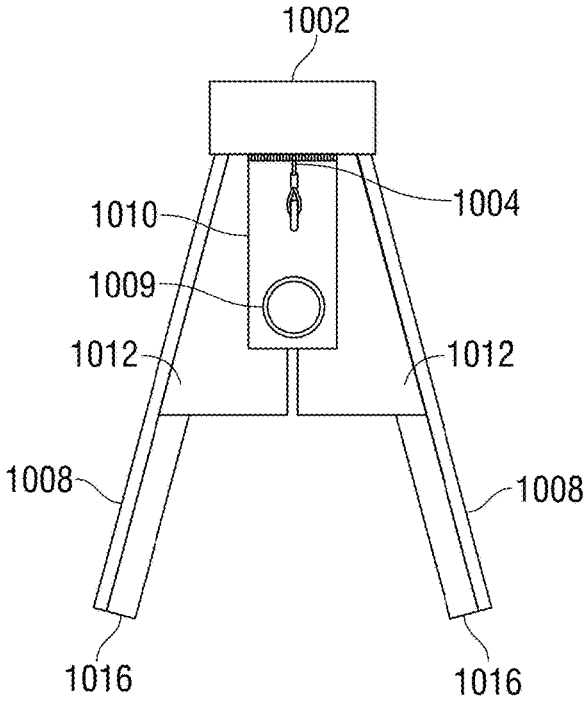

Doors 1008 may be constructed of any suitable material, but are typically light plastic sheets. FIG. 7 illustrates doors 1008 in the open state, when apparatus 1000 is not in use. FIGS. 8A and 8B depict top views of apparatus 1000 with doors 1008 in the open and closed states, respectively. In the open state, as shown in FIG. 8A, doors 1008 are perpendicular to mast 1006 (not visible under winch 1002). In the closed state, as shown in FIG. 8B, doors 1008 are held against the corners of mast 1006 (not visible under winch 1002). In the closed position, doors 1008 may be held against stabilizers 1016, as shown in FIG. 8B, or using any other suitable means.

Returning to FIG. 7, stabilizers 1016 may form a tripod (only two legs are visible in FIG. 7) or any other suitable shape. However, if doors 1008 are held closed against stabilizers 1016, the shape of stabilizers 1016 must match that of doors 1008 so that stabilizers 1016 and doors 1008 may be attached together.

Plates 1012, with semicircular cutouts forming hole 1014, sit on top of stabilizers 1016. Hole 1014 has a diameter such that tubular portions 20 may pass through hole 1014 but fasteners 25 may not.

Power drive 1010 may comprise a hydraulic motor, gas engine, or any other apparatus adapted to rotate tubular portions 20.

Figure 9:
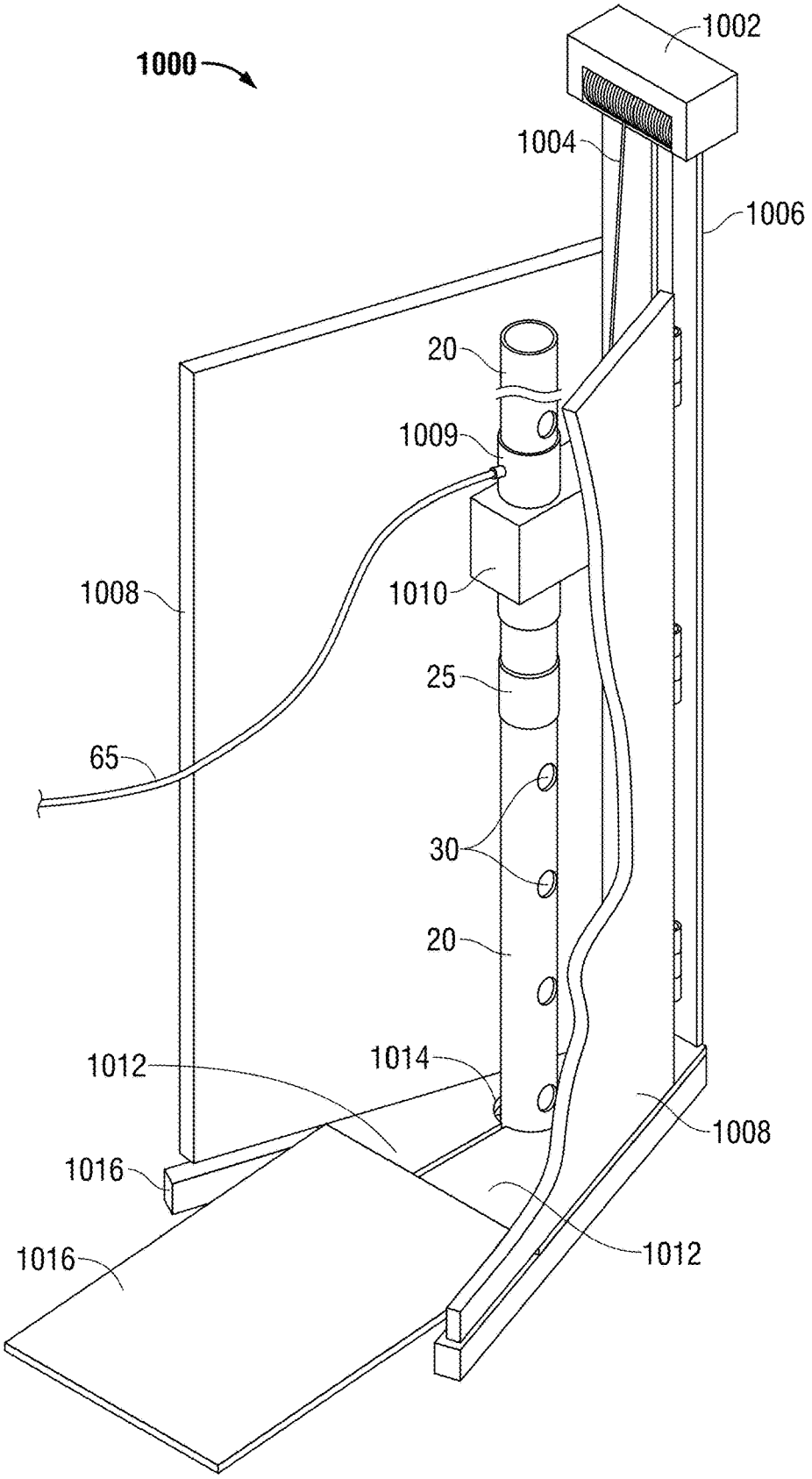
FIG. 9 displays a perspective view of an alternative well-drilling apparatus in the operational state, in accordance with embodiments.

FIG. 9 displays a perspective view of an alternative well-drilling apparatus 1000 in the operational state, in accordance with embodiments. Air hose 65 is affixed to drill stem connection 1009 above power drive 1010. Doors 1008 are held closed against mast 1006 by any suitable means. Tubular portion 20, having an open top portion, extends from above power drive 1010 down through power drive 1010 to fastener 25. Fastener 25 connects upper and lower tubular portions 20 just below power drive 1010. Lower tubular portion 20 extends from fastener 25 down through hole 1014 into the borehole being drilled. As illustrated here, lower tubular portion 20 includes a plurality of discharge ports 30. A lower tubular portion 20 without discharge ports 30 may also be employed, as discussed below.

Ramp 1018 extends out from plates 1012 beyond stabilizers 1016. In operation, a mixture of well debris, drilling water, and air may be carried up through well-drilling apparatus 1000 to the surface, out through any opened discharge port 30 and through the top open portion of upper tubular portion 20, against closed doors 1008, down along closed doors 1008, and along ramp 1018. Debris accumulates at the end of ramp 1018, while drilling water flows out the end and sides of ramp 1018 and back down into starter hole 160. Thus, well debris remains around starter hole 160 instead of being blown back into the aquifer, and the weight of the drilling water flowing back down into starter hole 160 stabilizes starter hole 160 by putting pressure on the sides of starter hole 160.

Mast 1006 must be high enough to accommodate insertion of tubular portions 20 of desired length. Tubular portions 20 may be any length convenient to handle and transport, but are typically five or ten feet in length. If five-foot tubular portions 20 are intended to be used, mast 1006 will typically be approximately eight feet tall. If ten-foot tubular portions 20 are intended to be used, mast 1006 will typically be approximately nineteen to twenty four feet tall. Shorter tubular portions 20 are easier to transport and assemble, but longer tubular portions 20 provide more efficient drilling operation.

Figure 10:
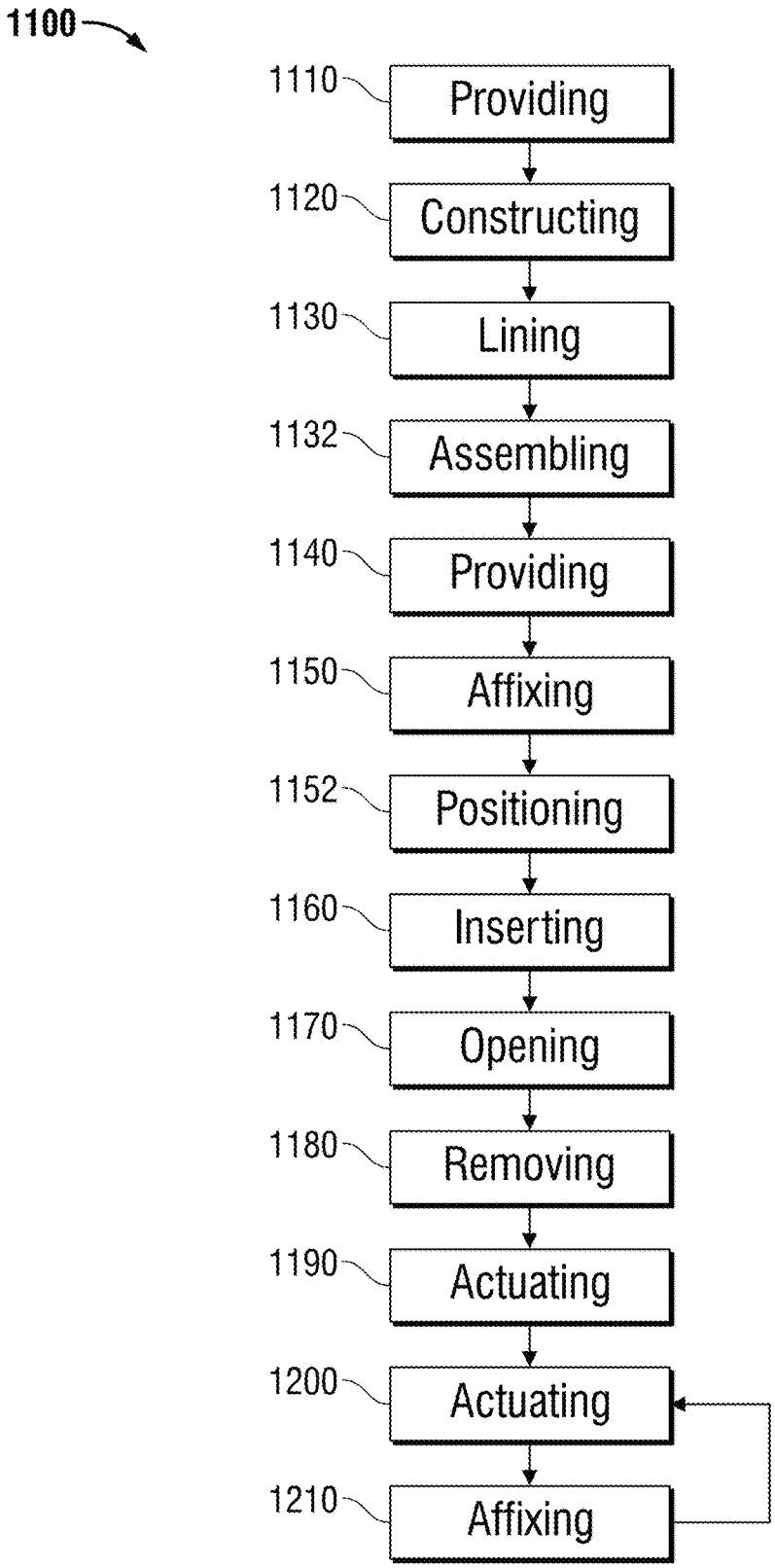
FIG. 10 displays a method for drilling a well in accordance with embodiments.

FIG. 10 displays a method 1100 for drilling a well in accordance with embodiments. Method 1100 is similar to method 300, previously discussed, but including additional steps. In step 1110, a well-drilling apparatus 1000 may be provided. The well-drilling apparatus 1000 may comprise one or more components as disclosed herein. In step 1120, a starter hole 160, having an interior surface area, may be constructed within the earth. Once created, in step 1130 the starter hole 160 may be lined with a covering, for example plastic 165, in order to keep the starter hole 160 from collapsing on itself.

In step 1132, apparatus 1000 is assembled and placed over starter hole 160, such that hole 1014 is directly above lined starter hole 160 and doors 1008 are in the opened position. Ramp 1018 is attached to plates 1012 and stabilizers 1016, and doors 1008 are positioned to be open. Apparatus 1000 may be partially or completely assembled before being placed over starter hole 160, or apparatus 1000 may be assembled while in place over starter hole 160. Once apparatus 1000 has been assembled and placed, in step 1140 the starter hole 160 may be provided with drill water utilized to assist in the drill within the starter hole 160. In step 1150, air hose 65 may be affixed to a brass inlet affixed to a tubular portion 20.

In step 1152, power drive 1010 is positioned at any convenient height on mast 1006, using winch 1002 and cable 1004 or by another means. In step 1154, a first, upper, tubular portion 20 is inserted down through the opening in power drive 1010. In step 1156, fastener 25 is affixed to the first tubular portion 20 just below power drive 1010, and a second, lower, tubular portion 20 is affixed to fastener 25 below power drive 1010. The second, lower, tubular portion 20 extends down from fastener 25 towards hole 1014.

In step 1160, power drive 1010 is positioned such that the second, lower, tubular portion 20 is inserted through hole 1014 into the pre-dug starter hole 160. In step 1170 the first discharge port 30 above the water elevation may be opened. At that point, in step 1180 the covering, for example plastic 165, may be removed from the starter hole 160 and doors 1008 are placed and held in the closed position. In step 1190 the air pressure device may be actuated in order to provide air to the air hose 65.

In step 1200, power drive 1010 may be actuated, driving tubular portions 20 in a rotatable motion, which may allow the apparatus 1000 to agitate debris found within the starter hole 160. A mixture of the debris, the drilling water, and the air may be carried through the well-drilling apparatus 1000 to the surface, out through opened discharge port 30, against closed doors 1008, down along closed doors 1008, and along ramp 1018. Debris accumulates at the end of ramp 1018, while drilling water flows out the end and sides of ramp 1018 and back down into starter hole 160. Power drive 1010 descends along with driven tubular portions 20.

Once lower tubular portion 20 sinks deep enough to where a second discharge port 30 reaches the top edge of the well, the second discharge port 30 may be opened and a first discharge port 30 may be closed. In embodiments, the air may be shut off and then turned on again when changing discharge ports 30. The process of opening and closing ports 30 may continue until the last port 30 on lower tubular portion 20 is opened and closed. Doors 1008 may be open and closed as necessary to access tubular portion 20.

In step 1210, when lower tubular portion 20 is almost fully inserted into the well, fastener 25, being too large to fit through hole 1014, will stop further descent. At this point power drive 1010 may be turned off and raised, ramp 1018 may be removed, doors 1008 may be opened, and plates 1012 may be separated to allow fastener 25 to fit through now-expanded hole 1014. A new fastener 25 may affixed to the top portion of upper tubular portion 20. A new tubular portion 20 may be inserted through power drive 1010 and the bottom portion of new tubular portion 20 may be affixed to new fastener 25. Plates 1012 may then be put back together, with previous fastener 25 now below hole 1014, ramp 1018 may be re-attached, and doors 1008 re-closed and secured. Then step 1200 may be repeated.

Steps 1200 and 1210 may be repeated until the drill stem is mostly submerged in the well. At this point, in step 1210 tubular portions 20 without discharge ports 30 may be used instead of tubular portions 20 having discharge ports 30. Steps 1200 and 1210 may then be repeated until the well has been drilled to the desired depth.

For the purposes of this disclosure, the terms "apparatus", "well-drilling apparatus", and "drill" may be synonymous.

For the purposes of this disclosure, the terms "well" and "borehole" may be synonymous.

In embodiments, the amount of water utilized to drill a well 55 may be 250 gallons or greater.

While this disclosure has been particularly shown and described with reference to preferred embodiments thereof and to the accompanying drawings, it will be understood by those skilled in the art that various changes in form and details may be made therein without departing from the spirit of this disclosure. Therefore, the scope of the disclosure is defined not by the detailed description but by the appended claims.

The invention claimed is:

1. A powered well-drilling apparatus, comprising:
- a mast;
- doors affixed to the mast, for deflecting well debris when secured in a closed position;
- stabilizers affixed to a bottom portion of the mast, for keeping the mast in the upright position;
- a power drive comprising a drill stem connection;
- a drill stem comprising a tubular elongated body, the tubular elongated body comprising:
  - a plurality of tubular portions;
  - a fastener, the fastener removably affixing two of the plurality of tubular portions together;
  - a plurality of discharge ports spaced along the length of the plurality of tubular portions;
- a plurality of removable plugs, wherein each of the plurality of removable plugs is configured to engage and close off a corresponding one of the plurality of discharge ports;
- plates with semicircular cutouts forming a hole, the diameter of the hole sufficiently large to allow passage of the plurality of tubular portions but sufficiently small to not allow passage of the fastener, the plates removably affixed to the stabilizers;
- a ramp, the ramp removably affixed to the stabilizers;
- a bit affixed to the lower end of one of the plurality of tubular portion, the bit comprising:
  - a plurality of prongs; and
  - an inlet port; and
- an air hose retainer affixed adjacent to the bit, the air hose retainer configured to retain a portion of an air hose, the air hose affixed between an inlet of the well-drilling apparatus and an air pressure device;
- wherein an open end of the air hose is disposed adjacent to the inlet port to create a reverse flow of air, water, and debris within the drill stem, and
- wherein as a portion of the drill stem with discharge ports in the open state is inserted into the well, lower discharge ports are closed when upper discharge ports reach a top edge of the well;
- an actuator for actuating the well-drilling apparatus in a rotatable motion, the actuating agitating debris found within the starter hole;
- a mixture carrier for carrying a mixture of the agitated debris, the drilling water, and the air through the well-drilling apparatus to a surface of the well.

2. The powered well-drilling apparatus of claim 1, the air hose positioned within the drill stem.

3. The powered well-drilling apparatus of claim 1, further comprising a plurality of actuators connected to a computing system, wherein the computing system sends protocol to the plurality of actuators to move the plurality of removable plugs adjacent the plurality of discharge ports.

4. A method for drilling a well comprising:
- providing a powered well-drilling apparatus, comprising:
  - a mast;
  - doors affixed to the mast, for deflecting well debris when secured in a closed position;
  - stabilizers affixed to a bottom portion of the mast, for keeping the mast in the upright position;
  - a power drive comprising a drill stem connection;
  - a drill stem comprising a tubular elongated body, the tubular elongated body comprising:
    - a plurality of tubular portion;
    - a fastener, the fastener removably affixing two of the plurality of tubular portions together;
    - a plurality of discharge ports spaced along the length of the plurality of tubular portions;
  - a plurality of removable plugs, wherein each of the plurality of removable plugs is configured to engage and close off a corresponding one of the plurality of discharge ports;
  - plates with semicircular cutouts forming a hole, the diameter of the hole sufficiently large to allow passage of the plurality of tubular portions but sufficiently small to not allow passage of the fastener, the plates removably affixed to the stabilizers;
  - a ramp, the ramp removably affixed to the stabilizers;
  - a bit affixed to the lower end of one of the plurality of tubular portion, the bit comprising:
    - a plurality of prongs; and
    - an inlet port; and
  - an air hose retainer affixed adjacent to the bit, the air hose retainer configured to retain a portion of an air hose, the air hose affixed between an inlet of the well-drilling apparatus and an air pressure device;
- constructing a starter hole in earth, the starter hole comprising an interior surface area;

lining the constructed starter hole with a covering, the covering affixed to the interior surface area of the starter hole;

placing a powered well-drilling apparatus above the lined starter hole;

providing drilling water to the lined starter hole;

affixing an air hose to an inlet of the well-drilling apparatus, the air hose affixed to an air pressure device;

positioning the power drive on the mast;

inserting a first tubular portion of the plurality of tubular portions through the drill stem connection;

affixing the fastener to a lower end of the first tubular portion inserted through the drill stem connection;

affixing the fastener to an upper end of a second tubular portion of the plurality of tubular portions;

then, positioning the power drive at a height such that the second tubular portion is inserted through the semicircular cutout sections into the lined starter hole previously provided with drilling water;

then, opening a first discharge port of the well-drilling apparatus, the first discharge port being positioned above the drilling water;

then, removing the covering from the lined starter hole and positioning the doors in the closed position;

then, actuating the air pressure device to provide air to the air hose;

then, actuating the power drive to drive the first and second tubular portions in a rotatable motion, the actuating agitating debris found within the starter hole and carrying a mixture of the debris, the drilling water, and the air through the well-drilling apparatus to a surface of the well;

as each of the plurality of discharge ports approaches the surface of the drilling water, closing each of the plurality of discharge ports and opening the next highest each of the plurality of discharge ports; and as the fastener affixing two tubular portions reaches the semicircular cutout sections, de-actuating and raising the power drive;

opening the plates to allow the fastener to be positioned beneath the plates, and re-closing the plates;

then, inserting a third tubular portion of the plurality of tubular portions through the drill stem connection;

using a second fastener, affixing a lower end of the third tubular portion inserted through the drill stem connection to an upper end of the first tubular portion of the plurality of tubular portions;

positioning the power drive at a height such that the first tubular portion is inserted through the semicircular cutout sections; and then, re-actuating the power drive to drive the second and third tubular portions in a rotatable motion.

* * * * *